US007268524B2

(12) United States Patent
Kase et al.

(10) Patent No.: US 7,268,524 B2
(45) Date of Patent: Sep. 11, 2007

(54) VOLTAGE REGULATOR WITH ADAPTIVE FREQUENCY COMPENSATION

(75) Inventors: Kiyoshi Kase, Austin, TX (US); May Len, Cedar Park, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 395 days.

(21) Appl. No.: 10/891,811

(22) Filed: Jul. 15, 2004

(65) Prior Publication Data

US 2006/0012356 A1 Jan. 19, 2006

(51) Int. Cl.
*G05F 1/40* (2006.01)

(52) U.S. Cl. ..... 323/282

(58) Field of Classification Search ..... 323/273, 323/280, 282, 283, 351
See application file for complete search history.

(56) References Cited

U.S. PATENT DOCUMENTS 4,887,278 A * 12/1989 Gupta ..... 375/219
6,246,221 B1 * 6/2001 Xi ..... 323/280
6,373,233 B2 * 4/2002 Bakker et al. ..... 323/282
6,556,083 B2 * 4/2003 Kadanka ..... 330/292
6,977,490 B1 * 12/2005 Zhang et al. ..... 323/280
2002/0105382 A1 8/2002 Kadanka

* cited by examiner

*Primary Examiner*—Adolf Berhane
(74) *Attorney, Agent, or Firm*—Joanna G. Chiu

(57) ABSTRACT

A voltage regulator includes a first and second amplifier stage, an output stage, and a variable zero circuit. The first amplifier stage is coupled to receive a reference voltage and introduces a first pole of the voltage regulator. The second amplifier stage is coupled to the first amplifier stage and introduces a second pole of the voltage regulator. The output stage is coupled to the second amplifier stage, has an output driver, and is coupled to provide an output voltage based on the reference voltage. The variable zero circuit is coupled to the first amplifier stage, the second amplifier stage, and the output stage. The variable zero circuit provides a zero to compensate for at least one of the first pole or the second pole of the voltage regulator based on a gate to source voltage of the output driver and a drain to source voltage of the output driver.

31 Claims, 3 Drawing Sheets

-PRIOR ART-

-PRIOR ART-

VOLTAGE REGULATOR WITH ADAPTIVE FREQUENCY COMPENSATION

FIELD OF THE INVENTION

The present invention relates generally to a voltage regulator and, more specifically to a voltage regulator with adaptive frequency compensation.

RELATED ART

In many electrical systems, it is desirable to maintain stability of the electrical system regardless of the load impedance applied to the circuitry. Since, for example, a variable load attached to a voltage regulator may cause an electrical system to become unstable, the output of the voltage regulator associated with the electrical system should be able to remain stable even when the impedance of the load attached to the voltage regulator varies over time.

Many of the known techniques used to regulate voltage at the output of the voltage regulator are designed to use a fixed frequency zero to "zero-out" the poles associated with each stage of the voltage regulator. However, when, for instance, the load added to the voltage regulator is a variable load, the frequency of the poles of the transfer functions of each stage affected by the variable load also vary. When the frequency of the zero added to correct the affected poles is fixed and the frequency of the corresponding poles varies, the zero that is provided does not accurately negate the effects of the added poles.

FIG. 1 illustrates a prior art voltage regulator 10. Voltage regulator 10 includes an amplifier 12, a buffer amplifier 14, a PMOS transistor 16, a feedback circuit 18, and a load 20. Load 20, which is coupled to the output of voltage regulator 10, includes a resistive element and a capacitive element. Amplifier 12 receives a reference voltage and a feedback signal (from feedback circuit 18) and amplifies the difference between the reference voltage and the feedback signal. Both the reference voltage and feedback signal are used to regulate the voltage provided at the output of voltage regulator 10. The output of amplifier 12 is provided as input to buffer amplifier 14. Buffer amplifier 14 amplifies the output of amplifier 12 and provides its output to the gate terminal of PMOS transistor 16. PMOS transistor 16 uses the output of amplifier 14 to control the amount of current provided to load 20.

FIG. 2 illustrates a gain-versus-frequency plot and a phase-versus-frequency plot corresponding to pole 1, pole 2, and pole 3 associated with each stage of voltage regulator 10 in FIG. 1 (labeled P1, P2, and P3, respectively). As illustrated in FIG. 2, as frequency increases, the gain of each pole associated with each stage of voltage regulator 10 decreases and the phase associated with each pole of voltage regulator 10 decreases. However, when the phase falls too low (such as, for example, below −180 degrees) before the gain reaches 0 dB, instability may result. Note that each pole within voltage regulator 10 causes a decrease in phase; therefore, in the illustrated example, at pole 3 the phase drops to −225 degrees, resulting in an unstable system.

Referring to FIG. 1, note that feedback circuit 18 only uses the drain current to manage the instability of voltage regulator 10. However, when voltage regulator 10 operates in the linear region (as opposed to the saturation region), small variations in the drain voltage (VD) result in large variations of the drain current; therefore, the use of the drain current does not effectively manage the instability of voltage regulator 10. That is, the use of the drain voltage alone does not adequately compensate for the poles of voltage regulator 10, thus allowing the phase margin at the 0 dB crossing to fall to levels which result in instability.

Therefore, the need exists for an improved voltage regulator that maintains a stable output voltage under variable load conditions.

BRIEF DESCRIPTION OF THE DRAWINGS

The present invention is illustrated by way of example and not limitation in the accompanying figures, in which like references indicate similar elements, and in which.

Figure 1:
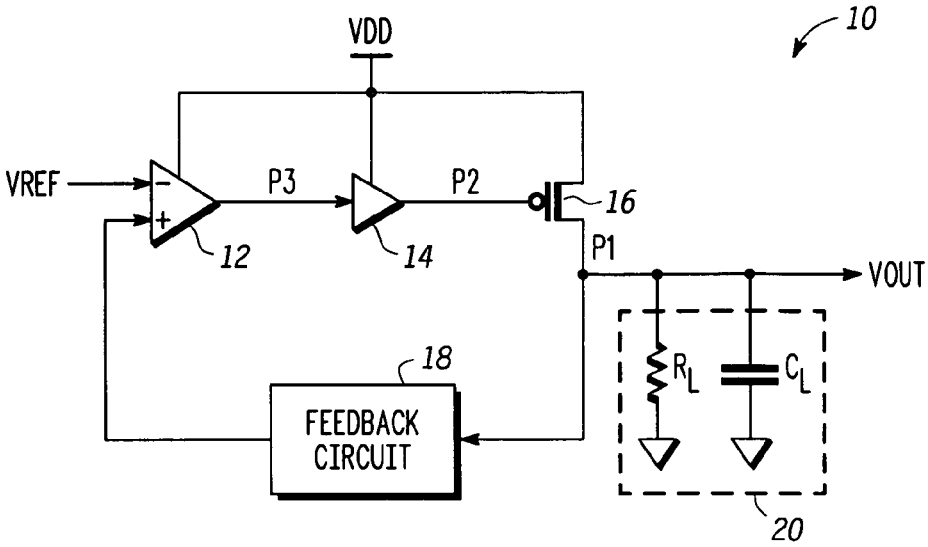
FIG. 1 illustrates, a block diagram of a voltage regulator according to an invention known in the art.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE DRAWINGS

In one embodiment of the present invention, a voltage regulator is provided that regulates the voltage supplied to a variable load. Instability issues that normally arise in a voltage regulator having a plurality of stages with one or more poles and a variable load attached thereto are addressed. In one embodiment, by allowing a variable zero circuit of the voltage regulator (described below) to adjust for the varying impedance of the variable load, the instability effects of the aforementioned poles may be negated.

In one embodiment of the present invention, a voltage regulator includes a first amplifier stage, a second amplifier stage, an output stage, and a variable zero circuit. The first amplifier stage is coupled to receive a reference voltage and introduces a first pole of the voltage regulator. The second amplifier stage is coupled to the first amplifier stage and introduces a second pole of the voltage regulator. The output stage is coupled to the second amplifier stage. The output stage has an output driver and is coupled to provide an output voltage based on the reference voltage. The variable zero circuit is coupled to the first amplifier stage, the second amplifier stage, and the output stage. The variable zero circuit provides a zero to compensate for at least one of the first pole or the second pole of the voltage regulator based on a gate to source voltage of the output driver and a drain to source voltage of the output driver.

In one embodiment, a voltage regulator includes a first amplifier stage, an output stage, and a variable zero circuit. The first amplifier stage is coupled to receive a reference voltage. The output stage is coupled to the first amplifier stage, has an output driver, and is coupled to provide an output voltage based on the reference voltage. The variable zero circuit is coupled to the first amplifier stage and the output stage. The variable zero circuit provides a zero to compensate for a first pole of the voltage regulator based on a gate to source voltage of the output driver and a drain to source voltage of the output driver.

In one embodiment, a voltage regulator includes a first amplifier stage, a second amplifier stage, an output stage, a variable resistor-capacitor (RC) circuit, a resistive element, a first transistor, and a second transistor. The first amplifier stage is coupled to receive a reference voltage. The second amplifier stage is coupled to the first amplifier stage. The output stage is coupled to the second amplifier stage, has an output driver, and is coupled to provide an output voltage based on the reference voltage. The resistive element has a first terminal coupled to a first supply voltage. The first transistor has a first current electrode coupled to a second terminal of the resistive element, a second current electrode coupled to a first current electrode of the output driver, and a control electrode coupled to a control electrode of the output driver. The second transistor has a first current electrode coupled to the second terminal of the resistive element, a control electrode coupled to the control electrode of the output driver, and a second current electrode coupled to the variable RC circuit.

In one embodiment, a method for providing an output voltage is disclosed. A reference voltage is provided to a first amplifier stage of a voltage regulator. An output voltage is generated based on the reference voltage. The output voltage is provided by an output driver of the voltage regulator. Based on a gate to source voltage and a drain to source voltage of the output driver, a zero is provided to compensate for a first pole of the voltage regulator.

Figure 3:
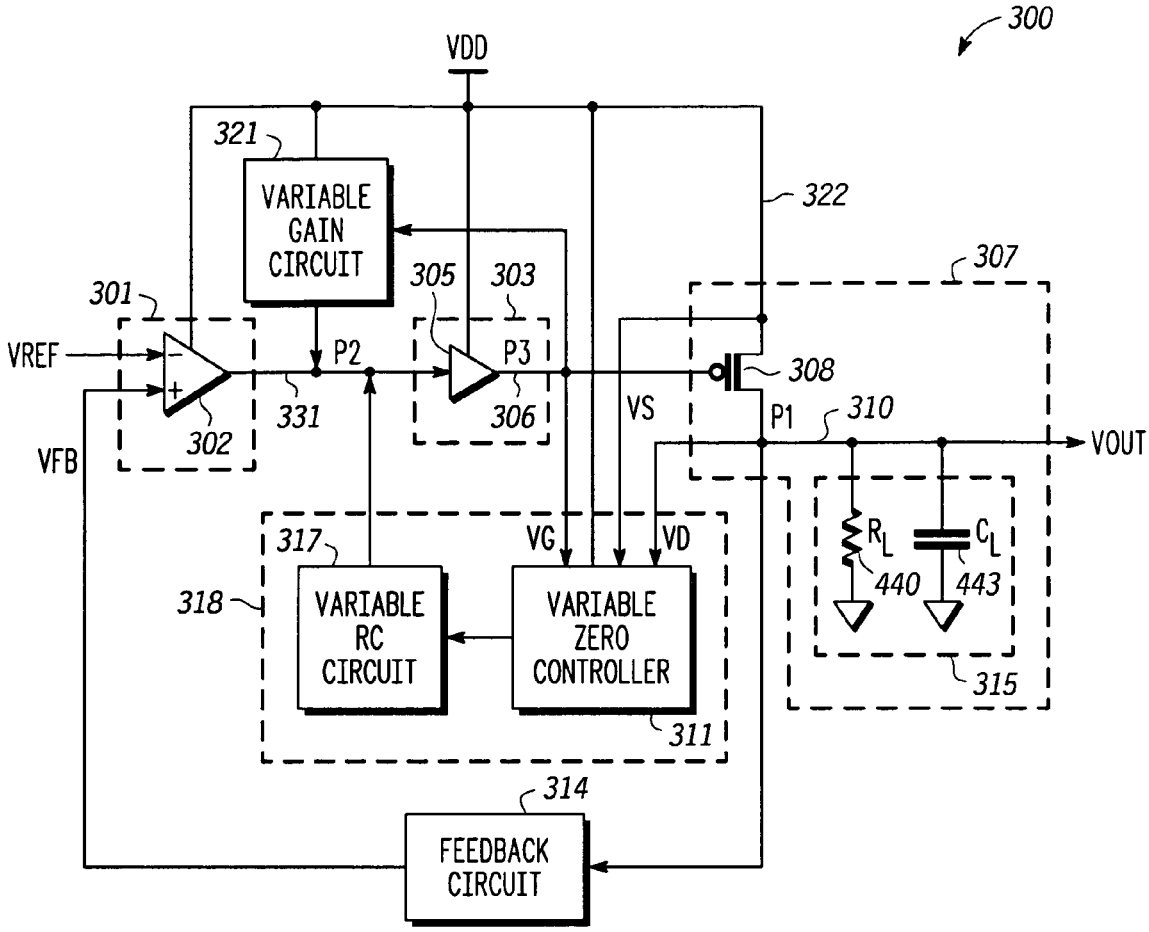
FIG. 3 illustrates, a block diagram of a voltage regulator, according to one embodiment of the present invention.

FIG. 3 illustrates a voltage regulator 300 according to one embodiment of the present invention. Voltage regulator 300 includes an amplifier stage 301, an amplifier stage 303, an output stage 307, a variable zero circuit 318, a variable gain circuit 321, and a feedback circuit 314. In one embodiment, amplifier stage 301 includes an amplifier 302, amplifier stage 303 includes an amplifier 305, and output stage 307 includes a transistor 308 (output driver 308) and a load 315. In one embodiment, transistor 308 may be a PMOS transistor. Load 315 includes a resistive element 440 (resistor 440) and a capacitive element 443 (capacitor 443). Variable zero circuit 318 includes a variable resistor-capacitor (RC) circuit 317 and a variable zero controller 311.

In one embodiment, the output of amplifier 302 is coupled to an input of amplifier 305, an output of variable gain circuit 321, and an output of variable RC circuit 317. The output of amplifier 305 is coupled to a control electrode of output driver 308, an input of variable gain circuit 321, and an input of variable zero controller 311 at node 306. A voltage source (not shown) is coupled to supply a voltage VDD to an input of amplifier 302, an input of variable gain circuit 321, an input of amplifier 305, an input of variable zero controller 311, and a first current electrode of output driver 308 at node 322. The first current electrode of output driver 308 is also coupled to an input of variable zero controller 311 at node 322. A second current electrode of output driver 308 is coupled to an input of variable zero controller 311, an input of feedback circuit 314, and an input of load 315 at node 310. An output of variable zero controller 311 is coupled to an input of variable RC circuit 317. An output of feedback circuit 314 is coupled to an input of amplifier 302.

During normal operation of voltage regulator 300, amplifier 302 is coupled to a voltage source and ground (not shown). In addition, load 315, which may be a load having variable load impedance, is coupled to node 310 of output stage 307. Amplifier 302 receives a reference voltage (VREF) from a reference voltage source (not shown) and a feedback voltage (VFB) from feedback circuit 314 and generates an amplified output at node 331. The amplified output of amplifier 302 includes a differential gain multiplied by the difference between reference voltage VREF and feedback voltage VFB. In one embodiment, amplifier 302 may be, for example, an operational amplifier.

In one embodiment, the output of amplifier 302, in conjunction with the output of variable zero circuit 318 and variable gain circuit 321, is used to maintain a regulated output voltage at node 310. In an alternate embodiment, the output of amplifier 302, in conjunction with the output of variable zero circuit 318, is used to maintain a regulated output voltage at node 310. That is, in one embodiment, variable gain circuit 321 may be an optional component of voltage regulator 300.

In one embodiment, the output of variable gain circuit 321, which is dependent upon the output of amplifier 305 via node 306, is provided to node 331 to adjust the differential gain associated with the output of amplifier 302. The output of amplifier 302, the output of variable gain circuit 321, and the output of variable zero circuit 318, are provided to amplifier 305 for further amplification. In one embodiment, amplifier 305 may be, for example, a buffer amplifier. The output of amplifier 305 is provided to an input of variable gain circuit 321, an input of variable zero circuit 318, and the control electrode of output driver 308. The control electrode of output driver 308 uses the output of amplifier 305 to regulate the amount of current provided to load 315, feedback circuit 314, and variable zero controller 311 at node 310. By regulating the amount of current provided to node 310, voltage regulator 300 is able to regulate the output voltage VOUT provided to load 315, when, for example, load 315 is a variable load.

As illustrated in FIG. 3, the electrical components of each stage of voltage regulator 300 may introduce a pole into each corresponding stage of voltage regulator 300. For example, amplifier 302 of amplifier stage 301 may introduce pole P2, amplifier 305 of amplifier stage 303 may introduce pole P3, and load 315 of output stage 307 may introduce pole P1.

Figure 2:
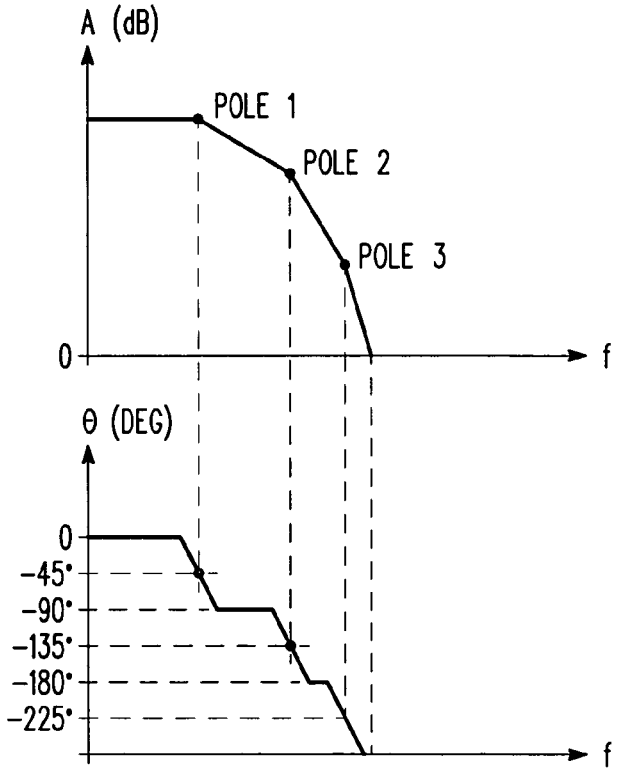
FIG. 2 illustrates, a gain-versus-frequency plot and a phase-versus-frequency plot corresponding to the voltage regulator of FIG. 1.

As is well known, the presence of more than one pole in the transfer function of a voltage regulator may cause a voltage regulator to become unstable if the additional poles are not adequately compensated for. For example, as described above in reference to FIG. 2, when the phase at the 0 dB crossing falls below −180 degrees, instability may result. By adequately compensating for these poles (such as with the additions of zeros to raise the phase margin), the phase corresponding to the 0 dB crossing may be maintained within the desired range (such as, for example, above −180 degrees), thus preventing instability. Furthermore, when a load coupled to a voltage regulator has varying impedance, standard compensation techniques, such as providing a fixed frequency zero, are not sufficient to compensate for the additional poles, since the fixed frequency zero generally does not lie close enough to the additional poles to counter their instability effects.

In one embodiment, when pole P2 that is introduced by amplifier stage 301 and pole P3 that is introduced by amplifier stage 303 of voltage regulator 300 lie within the active frequency range of the transfer function of voltage regulator 300, variable zero circuit 318 may be utilized to compensate for at least one of the poles. That is, variable zero circuit 318 may be used to introduce a zero into the transfer function of voltage regulator 300 to compensate for the poles introduced into the transfer function of voltage regulator 300 by amplifier stage 301 or amplifier stage 302 or both, thus preventing voltage regulator 300 from becoming unstable.

In one embodiment, a zero is provided to node 331 to compensate for pole P2 and pole P3. The zero provided to node 331 is dependent on the resistance of output driver 308. In alternate embodiments, the zero provided to node 331 may be used to compensate for additional poles of additional stages that may be added to voltage regulator 300. In order to sense the resistance of output driver 308, variable zero controller 311 receives a first current electrode voltage, a second current electrode voltage, and a control electrode voltage from output driver 308. In the illustrated embodiment, note that the first current electrode voltage refers to a source voltage (VS), the second current electrode voltage refers to a drain voltage (VD), and the control electrode voltage refers to a gate voltage (VG). In an alternate embodiment, the first current electrode voltage may be a drain voltage (VD), the second current electrode voltage may be a source voltage (VS), and the control electrode voltage may be a gate voltage (VG).

In one embodiment, variable zero controller 311 uses the first current electrode voltage, the second current electrode voltage, and the control electrode voltage of output driver 308 to generate a control voltage that is provided to variable RC circuit 317. The control voltage that is provided to variable RC circuit 317 varies based on the resistance of output driver 308. Variable RC circuit 317 receives the control voltage and generates a zero at node 331 that allows for the compensation of poles P2 and P3. Using the resistance of output driver 308 to generate the zero that is provided to node 331 allows for the zero to be adjusted based upon the impedance of load 315 that is coupled to the second electrode of PMOS transistor 308. The adjustment of the zero based upon the impedance of load 315 occurs as a result of the resistance of output driver 308 being dependent on the amount of current provided to load 315. In addition, since the output of amplifier 305 is dependent on the zero provided to node 331, variable gain circuit 321 is able to adjust the differential gain of the output of amplifier 302 based on the resistance of output driver 308.

For a voltage regulator that is driven to operate primarily in the saturation region, dependence on only the gate to source voltage may be sufficient to prevent stability. However, for a voltage regulator that is driven to operate primarily in or near the linear region, dependence on only the gate to source voltage may not be sufficient in and of itself to prevent the voltage regulator from becoming unstable. The ability of variable zero controller 311 described herein to sense the resistance of output driver 308 using the drain to source voltage and the gate to source voltage of output driver 308, allows voltage regulator 300 to maintain stability while operating in or near the linear region.

Figure 4:
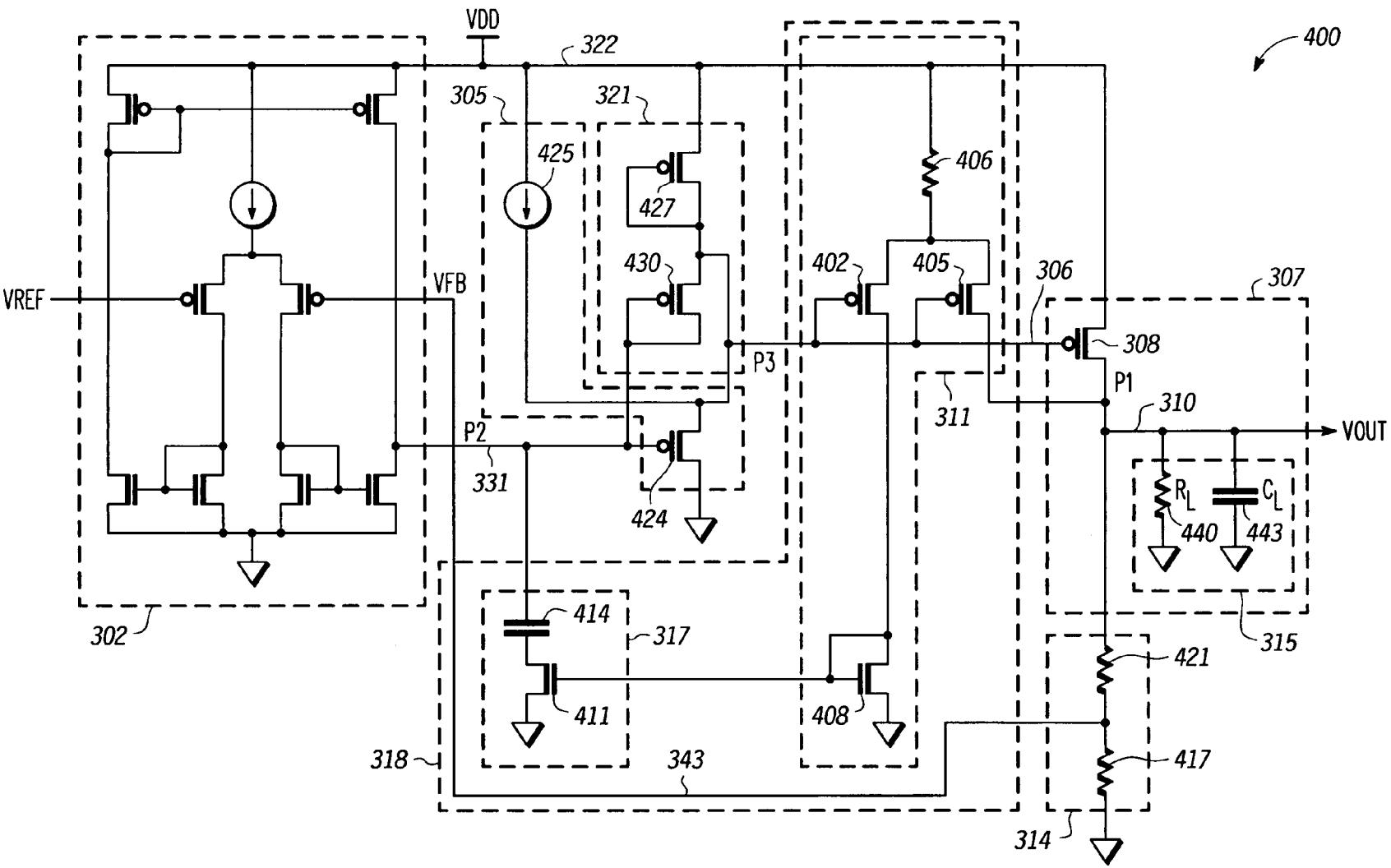
FIG. 4 illustrates, in circuit form, a voltage regulator, according to one embodiment of the present invention.

FIG. 4 is a schematic diagram illustrating voltage regulator 400 in accordance with one embodiment of the present invention. FIG. 4 depicts variable RC circuit 317, variable zero controller 311, feedback circuit 314, variable gain circuit 321, amplifier 305, and amplifier 302 in more detail.

As stated previously, during normal operation, amplifier 302 is coupled to receive a reference voltage VREF from a reference voltage source (not shown) and a feedback voltage signal (VFB) from feedback circuit 314. Feedback circuit 314 includes a resistor 421 coupled in series with a resistor 417. Resistor 421 has a terminal coupled to node 310 for receiving a current from output driver 308. Resistor 417 has a terminal coupled to ground. Feedback voltage VFB is provided to the non-inverting input of operational amplifier 302 from the node coupling resistor 421 to resistor 417. In one embodiment, amplifier 302 may be an operational amplifier whose components and functionality are well known in the art and are not discussed further in detail. Amplifier 302, which is coupled to variable RC circuit 317, amplifier 305, and variable gain circuit 321 at node 331, generates an amplified output at node 331. As stated previously, the gain of the amplified output at node 331 may be adjusted by variable gain circuit 321. In one embodiment, variable gain circuit 321 uses the gate to source voltage (VGS) of output driver 308 to adjust the gain of amplifier 302.

In one embodiment, variable gain circuit 321 includes a PMOS transistor 427 and a PMOS transistor 430. A first current electrode of PMOS transistor 427 is coupled to receive a voltage VDD from a voltage source at node 322. A second current electrode of PMOS transistor 427 and a control electrode of PMOS transistor 427 are coupled to a first current electrode of PMOS transistor 430 at node 306. In one embodiment, the first current electrode of PMOS transistor 427 is a source, the second current electrode of PMOS transistor 427 is a drain, and the control electrode of PMOS transistor 427 is a gate. A second current electrode of PMOS transistor 430 and a control electrode of PMOS transistor 430 are coupled to a control electrode of PMOS transistor 424 at node 331. In one embodiment, the control electrode of PMOS transistor 430 is a gate, the first current electrode of PMOS transistor 430 is a source, and the second current electrode of PMOS transistor 430 is a drain.

The control electrode of PMOS transistor 430 receives the output of amplifier 302 at node 331 and the current from the second current electrode of PMOS transistor 430. The current from the second current electrode of PMOS transistor 430 and the voltage at node 331 are used to adjust the gain of the output of amplifier 302. In addition, the output of amplifier 302 at node 331 and the current from the second current electrode of PMOS transistor 430 may be used to shift at least one of poles P2 and P3. In one embodiment, shifting of poles P2 and P3 allow for poles P2 and P3 to follow pole P1 of voltage regulator 300. As state previously, the amount of gain provided by variable gain circuit 321 to the output of amplifier 302 is based on the resistance of output driver 308.

In one embodiment, variable RC circuit 317 of voltage regulator 400 includes a capacitive element 414 (capacitor 414) and an NMOS transistor 411. Variable zero controller 311 includes an NMOS transistor 408, a PMOS transistor 402, a PMOS transistor 405, and a resistor 406. In one embodiment, resistor 406 may be a transistor. Capacitor 414 of variable RC circuit 317 has a terminal coupled to node 331 and a terminal coupled to a second current electrode of NMOS transistor 411. A first current electrode of NMOS transistor 411 is coupled to ground.

A control electrode of NMOS transistor 411 is coupled to a control electrode of NMOS transistor 408 and a second current electrode of PMOS transistor 402 to receive a control voltage which controls the frequency of the zero provided to node 331. In one embodiment, the control voltage that is provided to the control electrode of PMOS transistor 411 is based upon the current provided from the second current of electrode of PMOS transistor 402. In one embodiment, the control voltage provided to the control electrode of NMOS transistor 411 may be used to adjust the gain of amplifier 302. That is, the control voltage provided to the control electrode of NMOS transistor 411 may be used by the current source in amplifier 302 to affect the current source in amplifier 302. Variable RC circuit 317 then uses the control voltage to provide a zero to node 331 to compensate for pole P2 at the output of amplifier 302 and pole P3 at the output of amplifier 305.

In one embodiment, the second current electrode of PMOS transistor 402 is coupled to variable RC circuit 317 via NMOS transistor 408 in which NMOS transistor 408 operations as a current-to-voltage converter. In an alternate embodiment, the second current electrode of PMOS transistor 402 may be coupled to variable RC circuit 317 via a current mirror.

In one embodiment, variable zero controller 311 is coupled via node 306 to variable gain circuit 321, amplifier 305, and output driver 308. Resistor 406 has a terminal coupled to the voltage supply and a terminal coupled to a first current electrode of PMOS transistor 405 and a first current electrode of PMOS transistor 402. A second current electrode of PMOS transistor 402 is coupled to the second current electrode of NMOS transistor 408, the control electrode of NMOS transistor 408, and the control electrode of NMOS transistor 411. A second current electrode of PMOS transistor 405 is coupled to a second current electrode of output driver 308 at node 310. As stated previously, the second current electrode of PMOS transistor 402 provides a control voltage to the control electrode of NMOS transistor 411 based on both the gate to source voltage and drain to source voltage of output driver 308. The control electrode of PMOS transistor 402 and the control electrode of PMOS transistor 405 are coupled to receive the output of amplifier 305 at node 306.

In one embodiment, amplifier 305 includes a current source 425 and a PMOS transistor 424. Current source 425 has a terminal coupled to a voltage source and a terminal coupled to a first current electrode of PMOS transistor 424 at node 306. A second current electrode of PMOS transistor 424 is coupled to ground. The control electrode of PMOS transistor 424 is coupled to the control electrode of PMOS transistor 430, a second current electrode of PMOS transistor 430, amplifier 302, and capacitor 414 at node 331. The control electrode of PMOS transistor 424 receives the output of amplifier 302 at node 331 and amplifies the output of amplifier 302 using current source 425. The amplified output is provided to the control electrode of PMOS transistor 402 and PMOS transistor 405 to adjust the voltage at the control electrode of NMOS transistor 411. In addition, the amplified output is provided to the control electrode of output driver 308 to regulate the voltage provided at the second current electrode of output driver 308 to load 307.

In one embodiment, variable RC circuit 317 in combination with variable zero controller 311 combine to make up variable zero circuit 318. Variable zero circuit 318 uses the gate to source voltage and drain to source voltage of output driver 308 to compensate for pole P2 of amplifier stage 301 and pole P3 of amplifier stage 303 by providing a zero to node 331. The zero provided to node 331 is dependent upon the resistance of output driver 308, which is determined based on both the gate-to-source voltage and drain-to-source voltage of output driver 308. As a result, voltage regulator 400 is able to maintain stability with both a plurality of poles and a varying load impedance.

Note that as used herein, a first current electrode of a transistor (or device) may refer to a source or drain of the transistor, the second current electrode of the transistor may refer to the other one of the source or drain, and the control electrode of the transistor may refer to the gate or gate electrode of the transistor.

In the foregoing specification, the present invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A voltage regulator, comprising:

a first amplifier stage coupled to receive a reference voltage;

an output stage coupled to the first amplifier stage, the output stage having an output driver and coupled to provide an output voltage based on the reference voltage; and a variable zero circuit coupled to the first amplifier stage and the output stage, the variable zero circuit providing a zero to compensate for a first pole of the voltage regulator based on a gate to source voltage of the output driver and a drain to source voltage of the output driver.

2. The voltage regulator of claim 1, wherein the first amplifier stage introduces the first pole of the voltage regulator.

3. The voltage regulator of claim 1, further comprising:

a second amplifier stage coupled between the first amplifier stage and the output stage, wherein the second amplifier stage introduces the first pole of the voltage regulator.

4. The voltage regulator of claim 3, wherein the first amplifier stage introduces a second pole of the voltage regulator and the output stage introduces a third pole of the voltage regulator.

5. The voltage regulator of claim 1, wherein the variable zero circuit comprises a variable resistor-capacitor (RC) circuit, the variable zero circuit sensing the gate to source voltage and the drain to source voltage of the output driver and generating a control voltage to control the variable RC circuit.

6. The voltage regulator of claim 5, wherein the control voltage is generated based on the gate to source voltage and the drain to source voltage.

7. The voltage regulator of claim 6, wherein the variable RC circuit comprises a first transistor coupled to a capacitor, wherein the capacitor is coupled to the first amplifier stage and the control voltage is provided to a control electrode of the first transistor.

8. The voltage regulator of claim 1, further comprising:

a variable gain circuit coupled to the first amplifier stage and the output stage, the variable gain circuit adjusting a gain of the first amplifier stage based on the gate to source voltage of the output driver.

9. The voltage regulator of claim 8, wherein the variable gain circuit shifts the first pole of the voltage regulator.

10. A voltage regulator, comprising:

a first amplifier stage coupled to receive a reference voltage and introducing a first pole of the voltage regulator;

a second amplifier stage coupled to the first amplifier stage and introducing a second pole of the voltage regulator;

an output stage coupled to the second amplifier stage, the output stage having an output driver and coupled to provide an output voltage based on the reference voltage; and a variable zero circuit coupled to the first amplifier stage, the second amplifier stage, and the output stage, the variable zero circuit providing a zero to compensate for at least one of the first pole or the second pole of the voltage regulator based on a gate to source voltage of the output driver and a drain to source voltage of the output driver.

11. The voltage regulator of claim 10, wherein the variable zero circuit comprises:

a variable resistor-capacitor (RC) circuit;

a resistive element having a first terminal coupled to a first supply voltage;

a first transistor having a first current electrode coupled to a second terminal of the resistive element, a second current electrode coupled to a first current electrode of the output driver, and a control electrode coupled to a control electrode of the output driver; and a second transistor having a first current electrode coupled to the second terminal of the resistive element, a control electrode coupled to the control electrode of the output driver and a second current electrode coupled to the variable RC circuit.

12. The voltage regulator of claim 11, wherein the variable RC circuit comprises:

a capacitive element; and a third transistor having a control electrode coupled to receive a control voltage based on a current provided by the second current electrode of the second transistor, a first current electrode coupled to a second supply voltage, and a second current electrode coupled to a first terminal of the capacitive element.

13. The voltage regulator of claim 12, wherein a second terminal of the capacitive element is coupled to an output of the first amplifier stage.

14. The voltage regulator of claim 12, wherein a second terminal of the capacitive element is coupled to an output of the second amplifier stage.

15. The voltage regulator of claim 12, wherein the control voltage is used to adjust a gain of the first amplifier stage.

16. The voltage regulator of claim 10, wherein the variable zero circuit provides the zero to compensate for the first pole of the voltage regulator.

17. The voltage regulator of claim 10, wherein the variable zero circuit provides the zero to compensate for the second pole of the voltage regulator.

18. The voltage regulator of claim 10, further comprising:

a variable gain circuit coupled to the first amplifier stage and the output stage, the variable gain circuit adjusting a gain of the first amplifier stage based on the gate to source voltage of the output driver.

19. The voltage regulator of claim 18, wherein the variable gain circuit shifts at least one of the first pole and the second pole of the voltage regulator.

20. A voltage regulator, comprising:

a first amplifier stage coupled to receive a reference voltage;

a second amplifier stage coupled to the first amplifier stage;

an output stage coupled to the second amplifier stage, the output stage having an output driver and coupled to provide an output voltage based on the reference voltage;

a variable resistor-capacitor (RC) circuit;

a resistive element having a first terminal coupled to a first supply voltage;

a first transistor having a first current electrode coupled to a second terminal of the resistive element, a second current electrode coupled to a first current electrode of the output driver, and a control electrode coupled to a control electrode of the output driver; and a second transistor having a first current electrode coupled to the second terminal of the resistive element, a control electrode coupled to the control electrode of the output driver and a second current electrode coupled to the variable RC circuit.

21. The voltage regulator of claim 20, wherein the variable RC circuit provides a zero to compensate for at least a first pole of the voltage regulator.

22. The voltage regulator of claim 21, wherein the variable RC circuit is coupled to the first amplifier stage and the first amplifier stage provides the first pole of the voltage regulator.

23. The voltage regulator of claim 21, wherein the variable RC circuit is coupled to the second amplifier stage and the second amplifier stage provides the first pole of the voltage regulator.

24. The voltage regulator of claim 20, wherein the variable RC circuit comprises:

a capacitive element; and a third transistor having a control electrode coupled to receive a control voltage based on a current provided by the second current electrode of the second transistor, a first current electrode coupled to a second supply voltage, and a second current electrode coupled to a first terminal of the capacitive element.

25. The voltage regulator of claim 24, further comprising:

a fourth transistor having a first current electrode coupled to the second current electrode of the second transistor, a second current electrode coupled to the second supply voltage, and a control electrode coupled to the first current electrode of the fourth transistor and coupled to provide the control voltage to the variable RC circuit.

26. The voltage regulator of claim 24, wherein the capacitive element comprises at least one of a capacitor and a transistor.

27. The voltage regulator of claim 24, wherein the control voltage is used to adjust a gain of the first amplifier stage.

28. The voltage regulator of claim 20, wherein the resistive element comprises at least one of a resistor and a transistor.

29. A method for providing an output voltage comprising:

providing a reference voltage to a first amplifier stage of a voltage regulator;

generating an output voltage based on the reference voltage, the output voltage provided by an output driver of the voltage regulator; and based on a gate to source voltage and a drain to source voltage of the output driver, providing a zero to compensate for a first pole of the voltage regulator.

30. The method of claim 29, wherein the first pole of the voltage regulator is introduced by the first amplifier stage.

31. The method of claim 29 further comprising:

providing a second amplifier stage, wherein the first pole of the voltage regulator is introduced by the second amplifier stage.

* * * * *